US010775721B2

(12) United States Patent
Naruse

(10) Patent No.: US 10,775,721 B2
(45) Date of Patent: Sep. 15, 2020

(54) IMAGE FORMING APPARATUS

(71) Applicant: KONICA MINOLTA, INC., Chiyoda-ku, Tokyo (JP)

(72) Inventor: Kunihiko Naruse, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/386,192

(22) Filed: Apr. 16, 2019

(65) Prior Publication Data

US 2019/0324388 A1 Oct. 24, 2019

(30) Foreign Application Priority Data

Apr. 20, 2018 (JP) ..... 2018-081380

(51) Int. Cl.
*G03G 15/20* (2006.01)
*B65H 5/06* (2006.01)
*G03G 21/20* (2006.01)

(52) U.S. Cl.
CPC ..... *G03G 15/2017* (2013.01); *B65H 5/068* (2013.01); *G03G 21/206* (2013.01)

(58) Field of Classification Search
CPC .. G03G 21/20; G03G 21/206; G03G 15/2017; G03G 2221/1645
See application file for complete search history.

(56) References Cited

U.S. PATENT DOCUMENTS

| | | | | |
|---|---|---|---|---|
| 9,317,010 | B2 | 4/2016 | Nakamura et al. | |
| 9,519,267 | B2 | 12/2016 | Nakamura et al. | |
| 9,910,408 | B2 | 3/2018 | Nakamura et al. | |
| 2014/0376950 | A1* | 12/2014 | Hara | G03G 21/206 399/92 |
| 2015/0063858 | A1 | 3/2015 | Nakamura et al. | |
| 2016/0179054 | A1 | 6/2016 | Nakamura et al. | |
| 2017/0075302 | A1 | 3/2017 | Nakamura et al. | |
| 2018/0164742 | A1 | 6/2018 | Nakamura et al. | |

FOREIGN PATENT DOCUMENTS

| | | | |
|---|---|---|---|
| JP | 2006349826 | A | 12/2006 |
| JP | 2013190627 | A | 9/2013 |
| JP | 2016051000 | A | 4/2016 |

* cited by examiner

*Primary Examiner* — Thomas S Giampaolo, II
(74) *Attorney, Agent, or Firm* — Holtz, Holtz & Volek PC

(57) ABSTRACT

An image forming apparatus includes: a secondary transfer roller configured to transfer a toner image onto a sheet of paper; a fixing device provided downstream in a direction in which the sheet of paper is conveyed, the fixing device including a fixing roller that is configured to fix the toner image transferred onto the sheet of paper; a paper suction fan unit configured to suction air such that air flows over the secondary transfer roller; and a guide member provided in the paper suction fan unit and configured to guide air discharged from the paper suction fan unit to be discharged toward the fixing roller. The guide member is configured to guide air in a direction crossing a rotation axis of the fixing roller at least toward each of ends of the fixing roller in a direction of the rotation axis.

10 Claims, 14 Drawing Sheets

IMAGE FORMING APPARATUS

The entire disclosure of Japanese Patent Application No. 2018-081380, filed on Apr. 20, 2018, is incorporated herein by reference in its entirety.

BACKGROUND

Technological Field

The present invention relates to an image forming apparatus such as a copier, a laser beam printer, a facsimile machine, and a multi-functional peripheral thereof.

Description of the Related Art

An image forming apparatus applies heat to a toner image using a fixing device in order to fix the toner image onto a sheet of paper. A fixing roller provided inside the fixing device has a region over which a sheet of paper passes and to which heat is transferred, so that the temperature of this region lowers. This requires continuous application of heat while a sheet of paper is fed. As a result, the temperature tends to rise at each end of the fixing roller over which no sheet of paper passes.

Also, further acceleration of the speed of conveying a sheet of paper reveals problems that the stability for sheets of paper in a discharge unit of a secondary transfer roller is not kept, the heat in the fixing device rises to thereby increase the discharge amount of ultrafine particles (UFP), and the temperature inside the image forming apparatus rises.

Japanese Laid-Open Patent Publication No. 2006-349826 and Japanese Laid-Open Patent Publication No. 2016-51000 each disclose a technique for reducing the discharge amount of UFP by causing air to flow toward a fixing roller. Japanese Laid-Open Patent Publication No. 2013-190627 discloses a technique for configuring a fixing device to include a cooling fan for cooling a pressurizing roller.

SUMMARY

The above-described problems can be solved by providing an image forming apparatus with a fan for stabilizing the paper conveyance performance, a fan for cooling each end of a fixing roller, and a fan for collecting UFP. However, additional installments of fans lead to new problems that the image forming apparatus is increased in cost and size.

The present invention aims to solve the above-described problems and to provide an image forming apparatus configured such that air discharged from a fan for stabilizing the paper conveyance performance is used to cool each end of a fixing roller and then discharged through a filter, to thereby implement excellent paper conveyance performance, an appropriate interior temperature, cooling of each end of the fixing roller, and collection of UFP while suppressing increase in cost and size of the image forming apparatus.

To achieve at least one of the above-mentioned objects, according to an aspect of the present invention, an image forming apparatus reflecting one aspect of the present invention comprises: a secondary transfer roller configured to transfer a toner image onto a sheet of paper; a fixing device provided downstream in a direction in which the sheet of paper is conveyed, the fixing device including a fixing roller that is configured to fix the toner image transferred onto the sheet of paper; a paper suction fan unit configured to suction air such that air flows over the secondary transfer roller; a guide member provided in the paper suction fan unit and configured to guide air discharged from the paper suction fan unit to be discharged toward the fixing roller; and a filter device through which air discharged from the guide member passes to be discharged. The guide member is configured to guide air in a direction crossing a rotation axis of the fixing roller at least toward each of ends of the fixing roller in a direction of the rotation axis.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
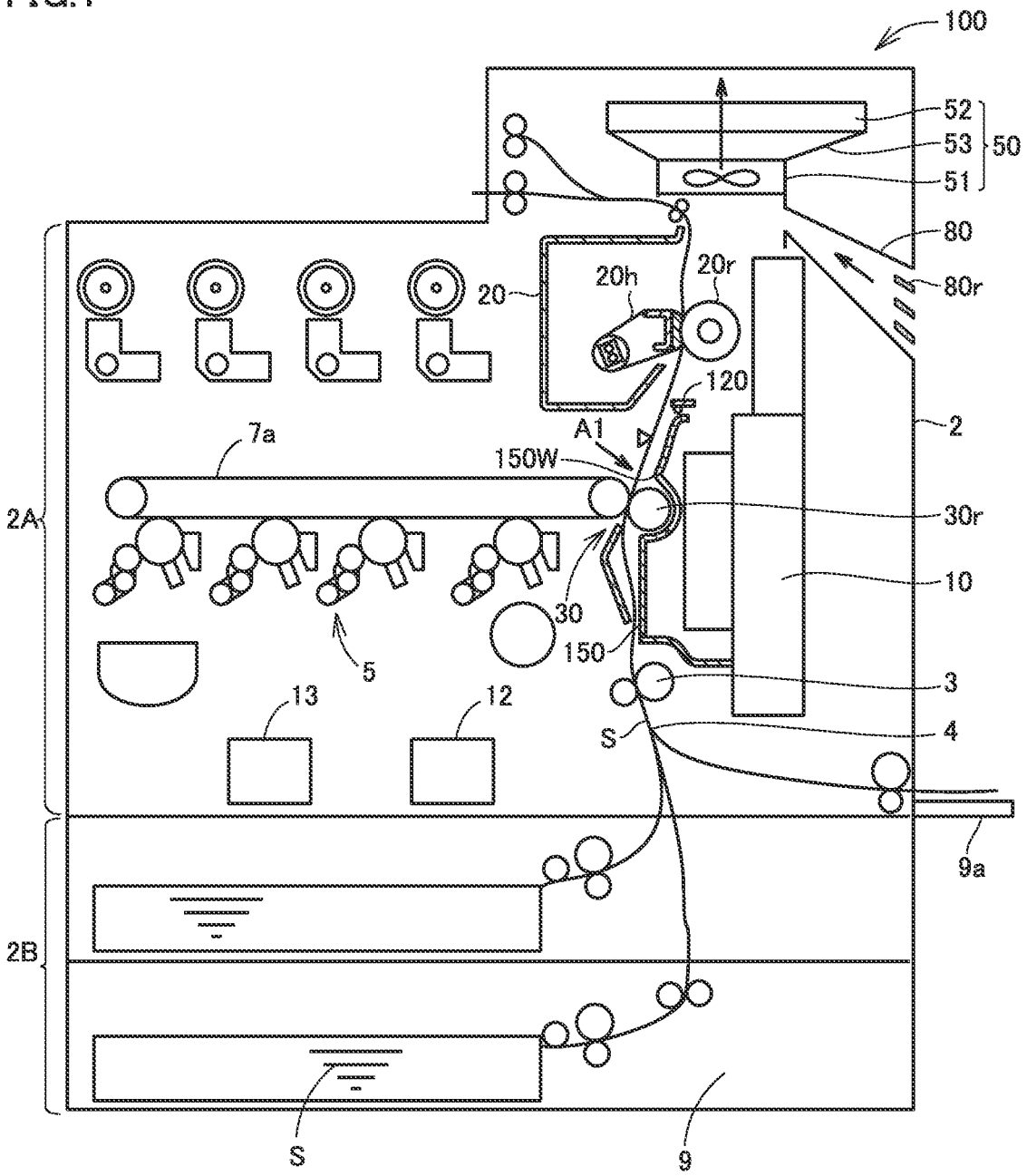
FIG. 1 is a schematic diagram showing the entire configuration of an image forming apparatus according to an embodiment.

Hereinafter, one or more embodiments of the present invention will be described with reference to the drawings. However, the scope of the invention is not limited to the disclosed embodiments.

In the following, an image forming apparatus according to the present embodiment will be described with reference to the accompanying drawings. In the embodiments described below, when the number, the quantity and the like are mentioned, the scope of the present invention is not necessarily limited thereto unless otherwise specified. The same or corresponding components are designated by the same reference characters, and the description thereof may not be repeated. The drawings are not shown in accordance with the actual dimensional ratio, and there are some parts shown in different dimensional ratios for clearly illustrating the structure in order to allow easy understanding of the structure.

(Image Forming Apparatus 100)

Figure 2:
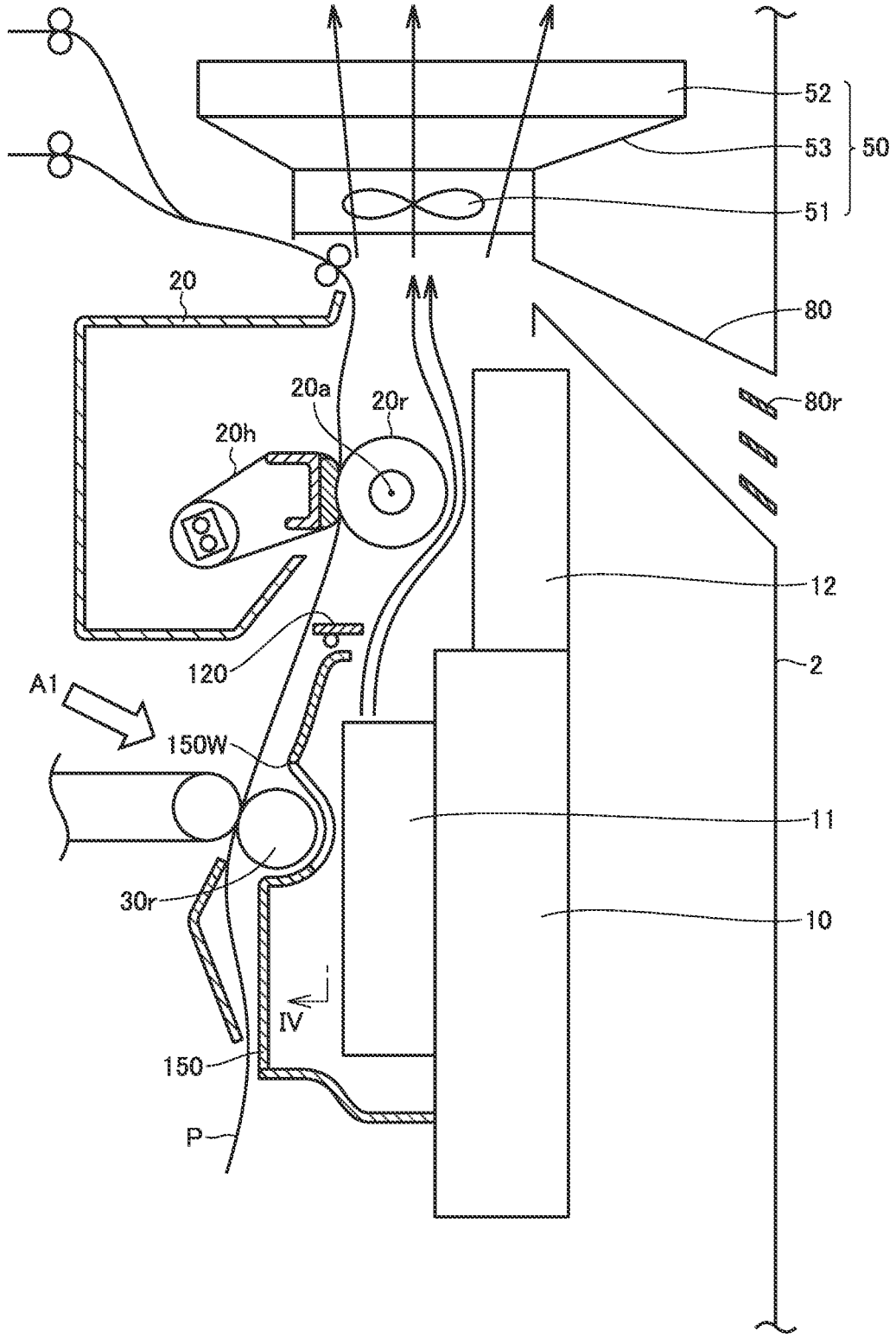
FIG. 2 is a partial enlarged view of a region including a secondary transfer section according to an embodiment.
Figure 3:
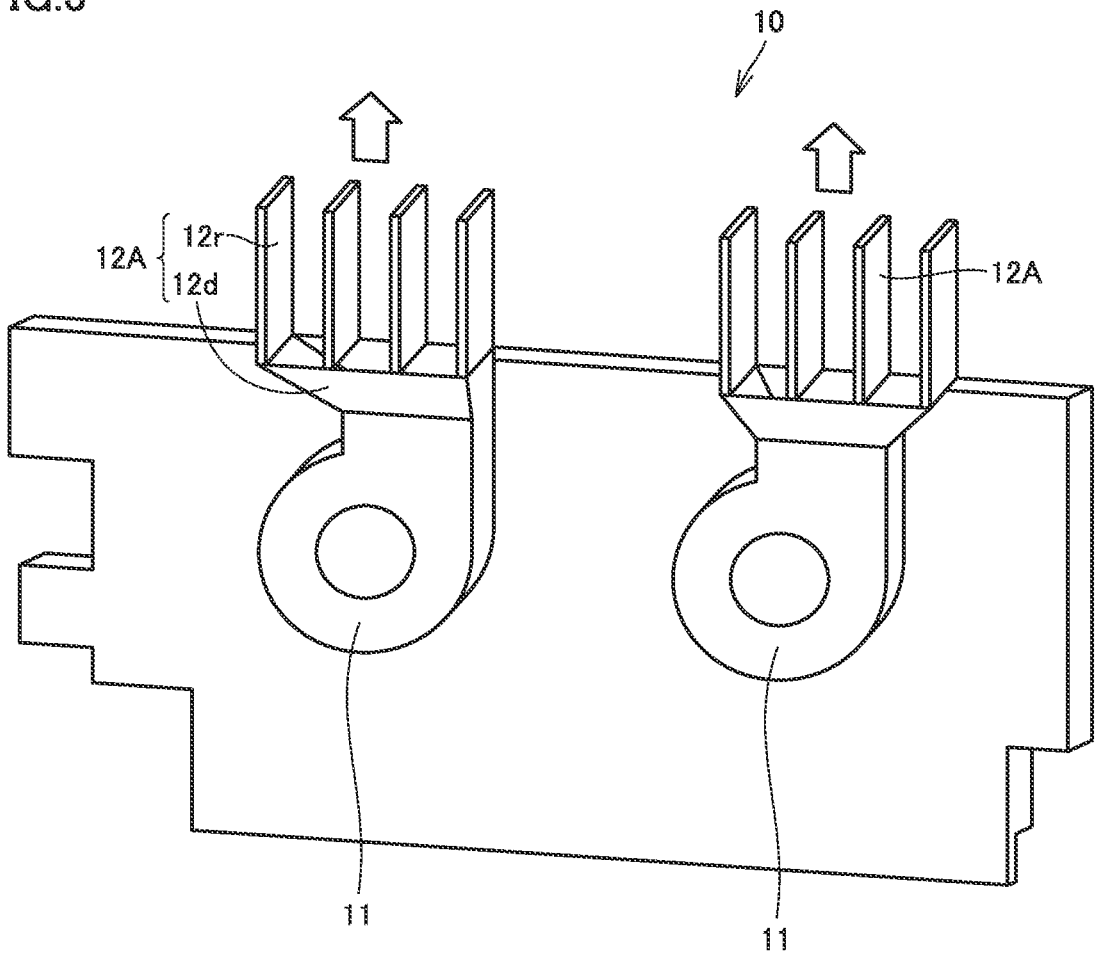
FIG. 3 is a perspective view showing the schematic configuration of a paper suction fan unit according to an embodiment.
Figure 4:
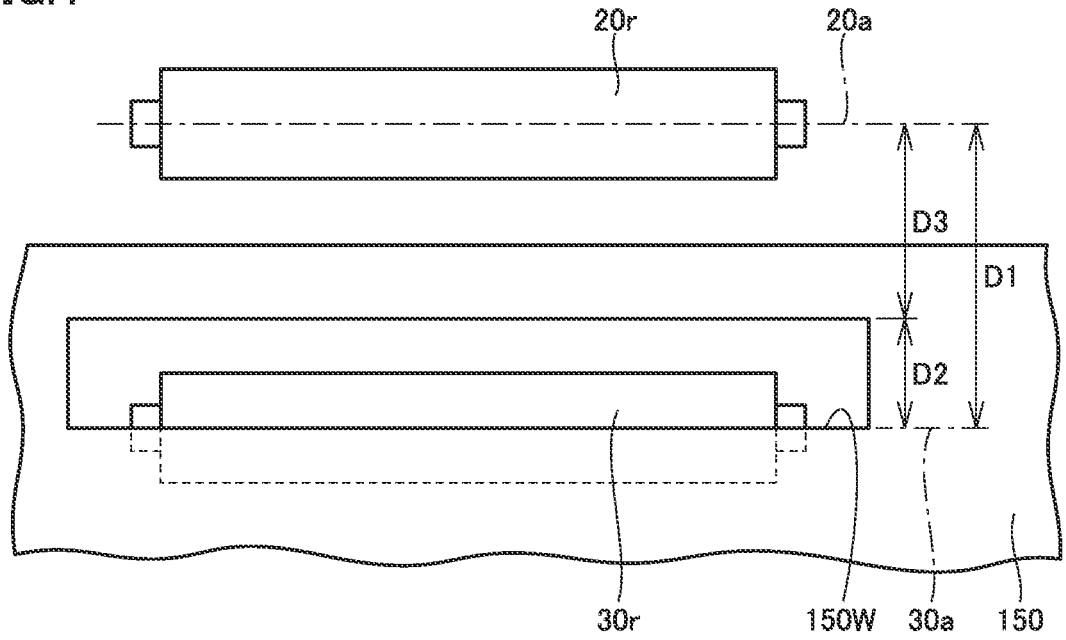
FIG. 4 is a view seen from the direction indicated by an arrow line IV in FIG. 2.
Figure 5:
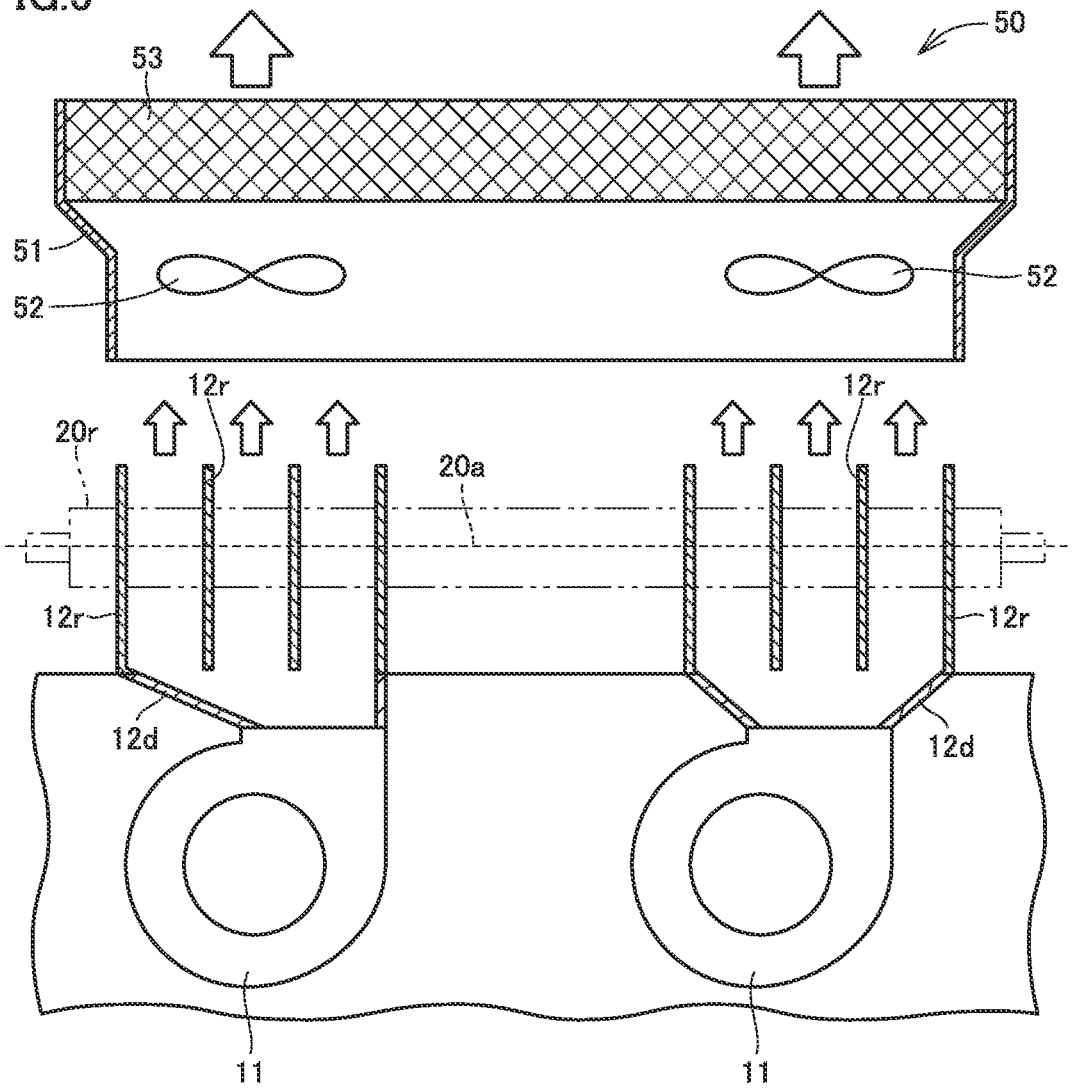
FIG. 5 is a diagram showing the configuration of the paper suction fan unit and a filter device according to an embodiment.

Referring to FIGS. 1 to 5, the schematic configuration of an image forming apparatus 100 in the present embodiment will be described. FIG. 1 is a schematic diagram showing the inner configuration of image forming apparatus 100. FIG. 2 is a partial enlarged view of a region including a secondary transfer section 30. FIG. 3 is a perspective view showing the schematic configuration of a paper suction fan unit 10. FIG. 4 is a diagram seen from the direction indicated by an arrow line IV in FIG. 2. FIG. 5 is a diagram showing the configuration of paper suction fan unit 10 and a filter device 50.

Referring to FIG. 1, image forming apparatus 100 mainly includes an apparatus main body 2 and a paper tray unit 9. Apparatus main body 2 includes: an image forming unit 2A serving to form an image on a sheet of paper S as a recording medium; and a paper feed unit 2B serving to feed sheet of paper S to image forming unit 2A. Paper tray unit 9 serves to store sheets of paper S to be fed to image forming unit 2A and is removably provided in paper feed unit 2B.

A plurality of rollers 3 are disposed inside image forming apparatus 100, so that a conveyance path 4 along which sheet of paper S is conveyed in a prescribed direction is formed across image forming unit 2A and paper feed unit 2B mentioned above. As shown in FIG. 1, apparatus main body 2 may be provided separately with a manual feed tray 9*a* for feeding sheet of paper S to image forming unit 2A.

Image forming unit 2A mainly includes: an imaging unit 5 capable of forming a toner image of each of colors including, for example, yellow (Y), magenta (M), cyan (C), and black (K); an intermediate transfer belt 7*a* tensioned over each imaging unit 5; a secondary transfer section 30 provided on conveyance path 4 and on a path of intermediate transfer belt 7*a*; and a fixing device 20 provided on conveyance path 4 downstream from secondary transfer section 30 including secondary transfer roller 30*r*.

Imaging unit 5 forms a toner image on the surface of a photoreceptor and transfers the formed toner image onto intermediate transfer belt 7*a* (that is, primary transfer). Thereby, a toner image as a color toner image or a monochrome toner image is formed on intermediate transfer belt 7*a*.

Intermediate transfer belt 7*a* conveys the toner image formed on its surface to secondary transfer section 30. Then, in secondary transfer section 30, intermediate transfer belt 7*a* is pressed into contact with sheet of paper S conveyed from paper feed unit 2B to secondary transfer section 30. Thereby, the toner image formed on the surface of intermediate transfer belt 7*a* is transferred onto sheet of paper S (the so-called secondary transfer).

The toner image transferred onto sheet of paper S is fixed by a heating device 20*h* and a fixing roller 20*r* in fixing device 20. Thereby, an image is formed on sheet of paper S. Then, sheet of paper S is discharged from apparatus main body 2.

Image forming apparatus 100 further includes a detector 12 and a controller 13. Detector 12 detects the size of sheet of paper S conveyed along conveyance path 4 from paper tray unit 9.

Image forming apparatus 100 includes a conveyance guide 150. Conveyance guide 150 is equipped with secondary transfer roller 30*r* rotatably about a rotation axis 30*a* (see FIG. 4). Furthermore, conveyance guide 150 is equipped with paper suction fan unit 10.

Referring to FIGS. 2 to 4, paper suction fan unit 10 includes two cross flow fans 11. Cross flow fan 11 is disposed on each of both sides in a view seen in the axis direction of a rotation axis 20*a* of fixing roller 20*r* (see FIG. 4). Cross flow fan 11 is located upstream from fixing device 20. This cross flow fan 11 serves to suction air through an air suction port 150W provided in conveyance guide 150 immediately downstream from secondary transfer roller 30*r* in order to separate sheet of paper S from secondary transfer roller 30*r* and to achieve the effect of stabilizing the posture of sheet of paper S.

Referring to FIG. 4, air suction port 150W provided in conveyance guide 150 may be provided on the downstream side of secondary transfer roller 30*r*. Furthermore, air suction port 150W may be provided with an opening so as to include the center region of secondary transfer roller 30*r*.

Furthermore, assuming that the distance between rotation axis 20*a* of fixing roller 20*r* and rotation axis 30*a* of secondary transfer roller 30*r* is defined as D1, the opening height (D2) of air suction port 150W may establish the relation of [D1/2]>D2 (D3>D2).

Thereby, the separability of sheet of paper S from secondary transfer roller 30*r* can be assisted while the stability of conveyance performance of sheet of paper S can be improved. In the present embodiment, air suction port 150W is formed in a horizontally-long rectangular shape as one hole, but a plurality of holes may be provided as air suction port 150W.

Cross flow fan 11 suctions air from the center portion and blows air toward fixing roller 20*r* of fixing device 20. Cross flow fan 11 includes a guide member 12A. Guide member 12A includes: a duct 12*d* configured to guide air toward fixing roller 20*r*, and a plurality of fins 12*r* provided continuous to this duct 12*d* and configured to adjust the flow of air blown through duct 12*d* toward fixing roller 20*r*.

The air discharged from cross flow fan 11 flows through duct 12*d* and fins 12*r*, and then, is blown toward both ends of fixing roller 20*r* in the direction crossing the direction along rotation axis 20*a* of fixing roller 20*r* (upward in the figure).

Referring to FIG. 5, filter device 50 is provided above two cross flow fans 11 (on the downstream side in the air flow). Filter device 50 includes one filter duct 51 for covering fins 12*r* on both sides to gather air discharged from each cross flow fan 11 at one place.

Suction fans 52 for suctioning air upward (on the downstream side in the air flow) are provided at two positions inside filter duct 51. Furthermore, a filter member 53 is provided above suction fans 52 (on the downstream side in the air flow). In the present embodiment, it is preferable that filter member 53 is provided with a filter for collecting UFP.

As described above, by employing filter duct 51 that gathers air discharged from each cross flow fan 11 at one place, it is sufficient to prepare only one filter member 53 irrespective of the number of cross flow fans 11.

Suction fan 52 is configured to suction air discharged from cross flow fan 11 for paper suction so as to prevent the air from being discharged together with sheet of paper S to the paper discharge port after passing through fixing device 20.

In this way, in image forming apparatus 100 according to the present embodiment, cross flow fan 11 attached to conveyance guide 150 provided with secondary transfer roller 30*r* is used to suction air through air suction port 150W provided in conveyance guide 150 upstream from fixing device 20, to discharge the air toward both axial ends of fixing roller 20*r* in the direction crossing the direction along rotation axis 20*a* of fixing roller 20*r*, and then, further discharge the air through filter device 50.

Thus, the air discharged from cross flow fan 11 for stabilizing the paper conveyance performance is used to cool each end of fixing roller 20*r*, and then, discharged through filter device 50, to thereby allow excellent paper conveyance performance, an appropriate interior temperature, cooling of each end of fixing roller 20*r*, and collection of UFP while suppressing increase in cost and size of the image forming apparatus.

Although two cross flow fans 11 are provided in the above-described embodiment, one cross flow fan 11 may be used to cause air to blow toward both ends of fixing roller 20*r*.

(Opening Adjustment Mechanism 40)

Figure 6:
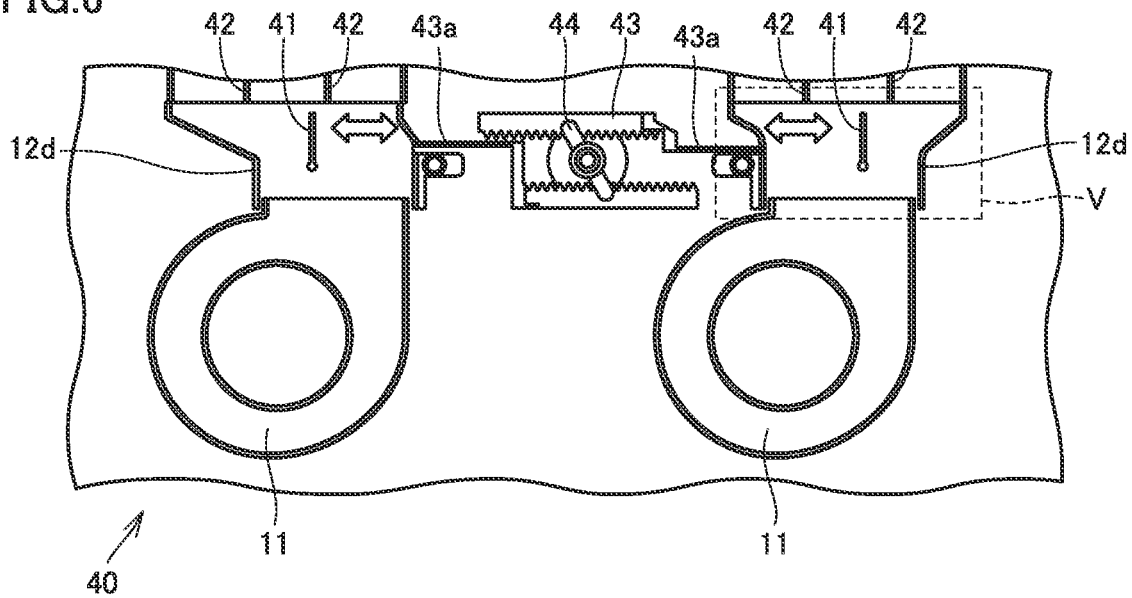
FIG. 6 is a schematic diagram showing an opening adjustment mechanism according to an embodiment.
Figure 7:
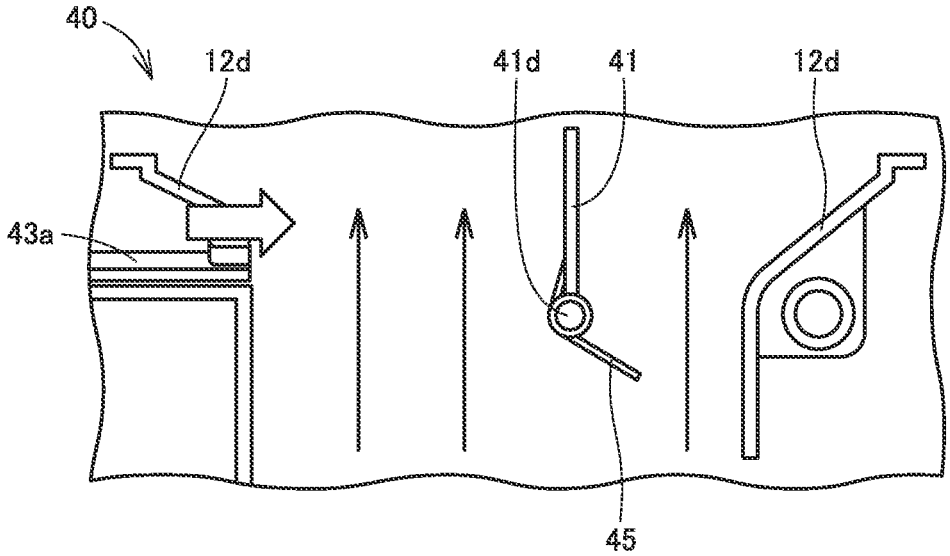
FIG. 7 is a diagram showing the first state of the opening adjustment mechanism according to an embodiment.
Figure 8:
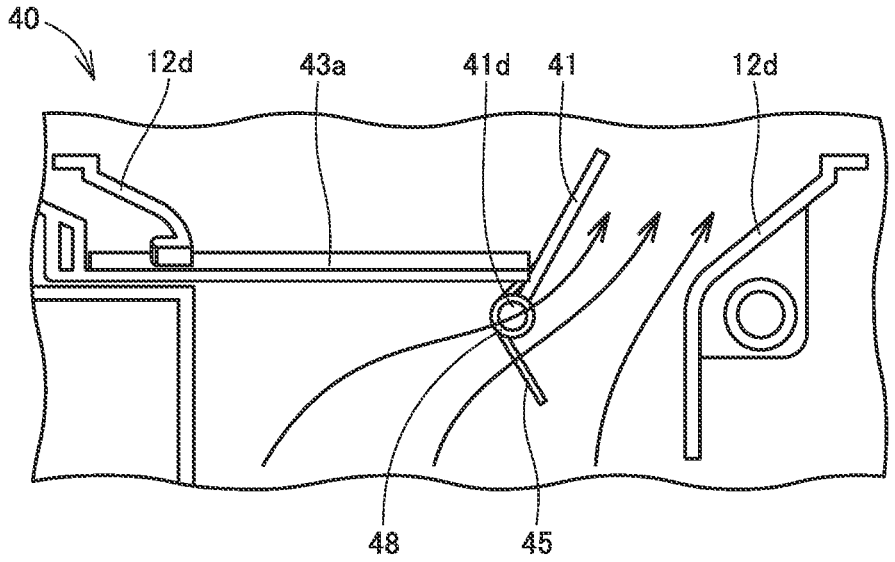
FIG. 8 is a diagram showing the second state of the opening adjustment mechanism according to an embodiment.
Figure 9:
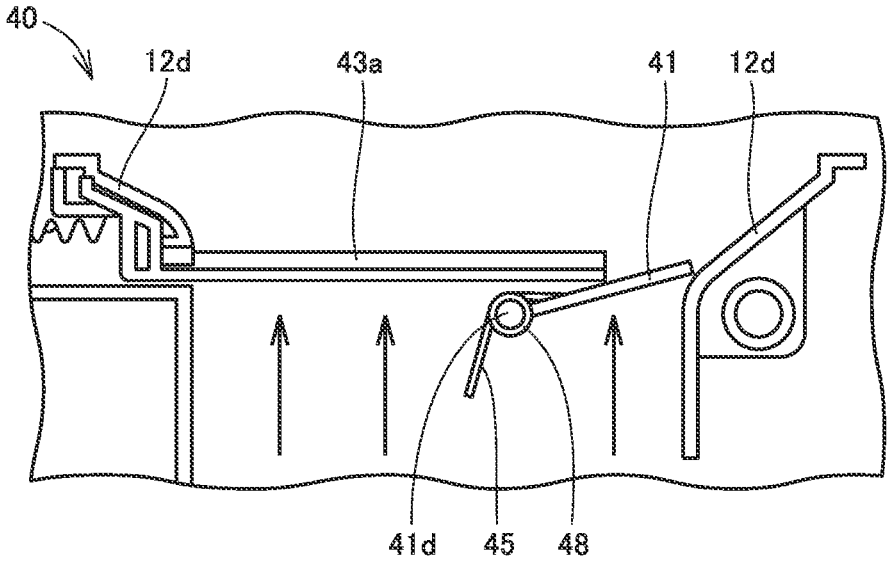
FIG. 9 is a diagram showing the third state of the opening adjustment mechanism according to an embodiment.

In the following, preferable embodiments will be described. Referring to FIGS. 6 to 9, an example of opening adjustment mechanism 40 at the air outlet port to fixing roller 20*r* will be described. FIG. 6 is a schematic diagram showing opening adjustment mechanism 40. FIGS. 7 to 9 each are diagrams showing the first to third states of opening adjustment mechanism 40. Opening adjustment mechanism 40 is controlled by controller 13 based on the size of sheet of paper S detected by detector 12.

Referring to FIG. 6, opening adjustment mechanism 40 includes a stepping motor 44 having a pinion gear. Stepping motor 44 is provided with a pair of racks 43 to be screwed into the pinion gear. Each of racks 43 is provided with an opening and closing plate 43*a* so as to be capable of protruding toward the inside of duct 12*d*. A pivot plate 41 is provided inside duct 12*d* so as to be pivotable upon contact with opening and closing plate 43*a*. Pivot plate 41 has a shaft 41*d* and is biased by a pivot spring 45 so as to be kept standing upright. Since the opening adjustment mechanism 40 has the same configuration on its right and left sides, the configuration of opening adjustment mechanism 40 on the left side in the figure will be described below.

In the state shown in FIG. 7, opening and closing plate 43*a* is waiting at the position receding from the inside of duct 12*d*, so that the inside of duct 12*d* is opened. As a result, the air discharged from cross flow fan 11 is entirely fed toward both ends of fixing roller 20*r*. This state is employed when the size of sheet of paper S (the size of fixing roller 20*r* in the direction of rotation axis 20*a*) is relatively small, that is, when the area of each end of fixing roller 20*r* over which sheet of paper S does not pass is relatively large.

The state shown in FIG. 8 shows the state where rotation of stepping motor 44 is controlled to cause opening and closing plate 43*a* to protrude to the position where opening and closing plate 43*a* comes into contact with pivot plate 41. In this state, the inside area of duct 12*d* is closed by opening and closing plate 43*a*, so that the air discharge from cross flow fan 11 is guided toward outside. This state is employed when the size of sheet of paper S is not largest but is greater than the size of sheet of paper S in the state shown in FIG. 6.

FIG. 9 shows the state where rotation of stepping motor 44 is controlled to cause opening and closing plate 43*a* to come into contact with pivot plate 41 and to cause opening and closing plate 43*a* to protrude to the position where opening and closing plate 43*a* presses pivot plate 41 so as to be inclined downward against the biasing force of pivot spring 45. In this state, the inside area of duct 12*d* is closed by opening and closing plate 43*a* and pivot plate 41, so that the air discharged from cross flow fan 11 is not fed to the fixing roller 20*r* side. This state is employed when the size of sheet of paper S is largest.

In this way, control can be performed: so as to increase the area of duct 12*d* through which air flows since the area of fixing roller 20*r* not in contact with the fed sheet of paper S is relatively large when sheet of paper S is relatively small; and so as to decrease the area of duct 12*d* through which air flows since the area of fixing roller 20*r* not in contact with the fed sheet of paper S is relatively small when sheet of paper S is relatively large.

(Path Displacing Device 120)

When the size of sheet of paper S is relatively large, the area of fixing roller 20*r* not in contact with the sheet of paper is relatively small. Thus, it is conceivable that the air discharged from cross flow fan 11 does not have to be fed into fixing roller 20*r*. In such a case, path displacing device 120 may be provided above cross flow fan 11 as shown in FIG. 2.

Figure 10:
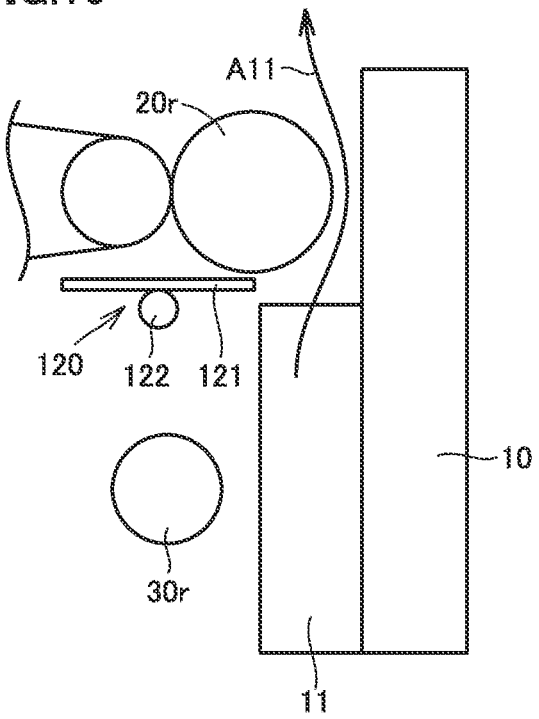
FIG. 10 is a diagram showing the first state of a path displacing device according to an embodiment.
Figure 11:
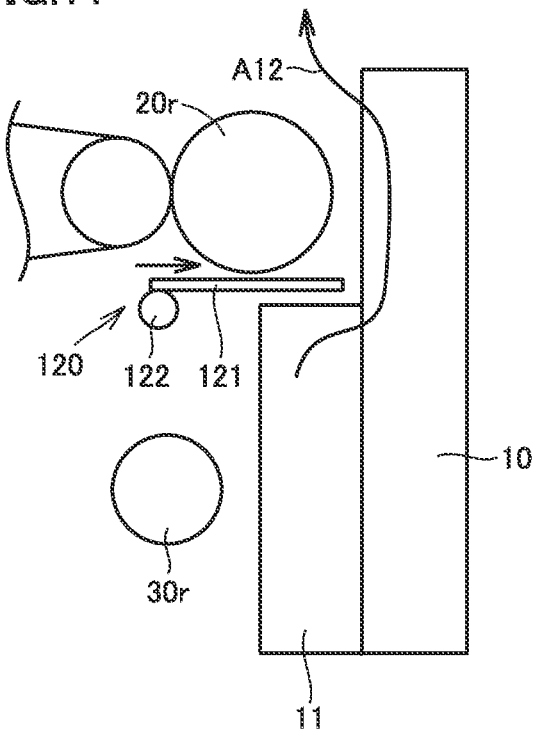
FIG. 11 is a diagram showing the second state of the path displacing device according to an embodiment.

FIGS. 10 and 11 each show the schematic configuration of path displacing device 120. FIGS. 10 and 11 are diagrams showing the first state and the second state of path displacing device 120. Path displacing device 120 is provided upstream from fixing roller 20*r* and includes a path displacing plate 121 and a stepping motor 122. By a rack and pinion mechanism provided between path displacing plate 121 and stepping motor 122, path displacing plate 121 is allowed to protrude so as to be located above cross flow fan 11.

In the state shown in FIG. 10, path displacing plate 121 is located at the receded position. Thus, all air discharged from cross flow fan 11 flows through a path A11 leading to fixing roller 20*r*. In the state shown in FIG. 11, stepping motor 122 controls the position of path displacing plate 121 such that path displacing plate 121 is moved so as to protrude toward cross flow fan 11. The air discharged from cross flow fan 11 is blocked by path displacing plate 121 and moved away from fixing roller 20*r*, so that the air is to flow through a path A12 displaced from fixing roller 20*r*.

In this way, the flow path of the air discharged from cross flow fan 11 is displaced by path displacing device 120 in accordance with the size of sheet of paper S. Thus, when the size of sheet of paper S is relatively large, cooling of fixing roller 20*r* leads to wasteful consumption of electric power. Accordingly, air is caused to flow in a protruding manner along path A12 through which air is not brought into contact with fixing roller 20*r*.

When the size of sheet of paper S is relatively small, air is caused to flow in a protruding manner through path A11 in the direction crossing fixing roller 20*r* in order to cool each end of fixing roller 20*r*. Furthermore, the smaller the size of sheet of paper S is, the more the area of duct 12*d* through which air flows may be increased, thereby increasing the range in which each end of fixing roller 20*r* is cooled, as described above.

(Outside Air Intake Duct 80)

Figure 12:
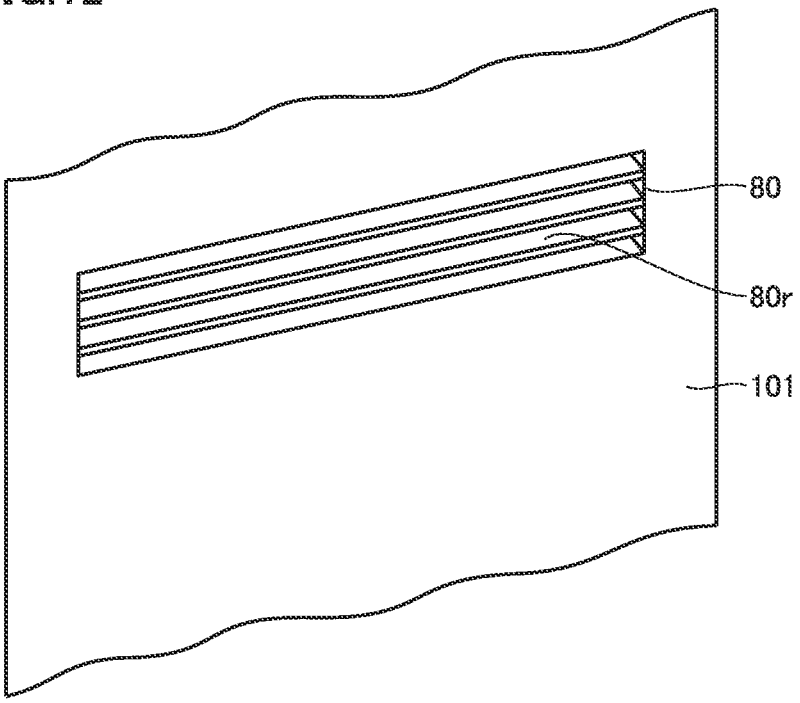
FIG. 12 is a perspective view showing the external appearance of an outside air intake port according to an embodiment.
Figure 13:
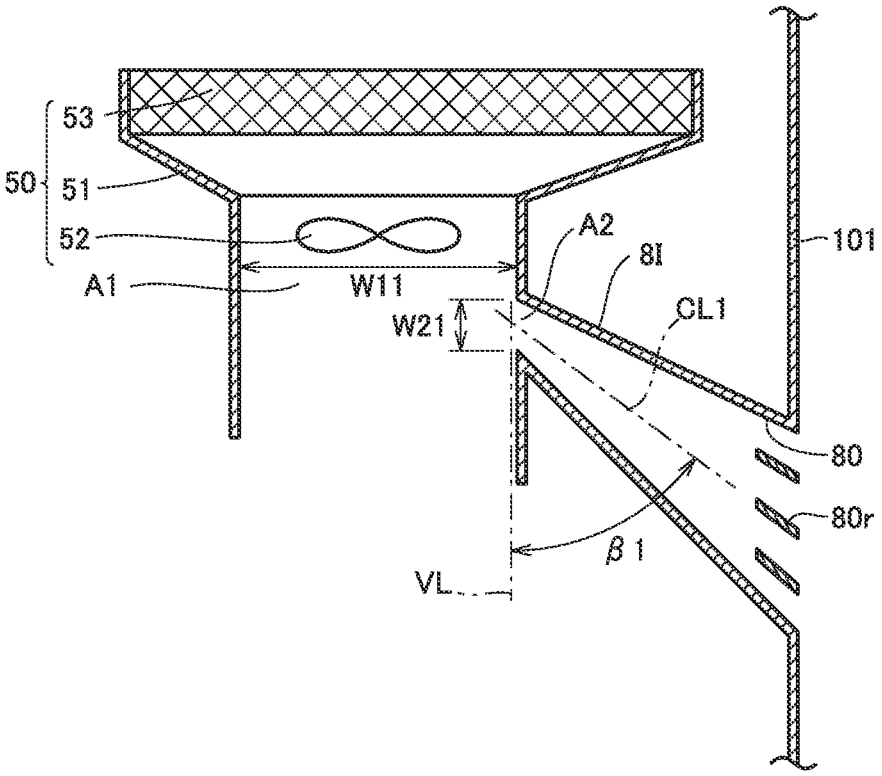
FIG. 13 is a longitudinal cross-sectional view showing the configuration of the outside air intake port according to an embodiment.
Figure 14:
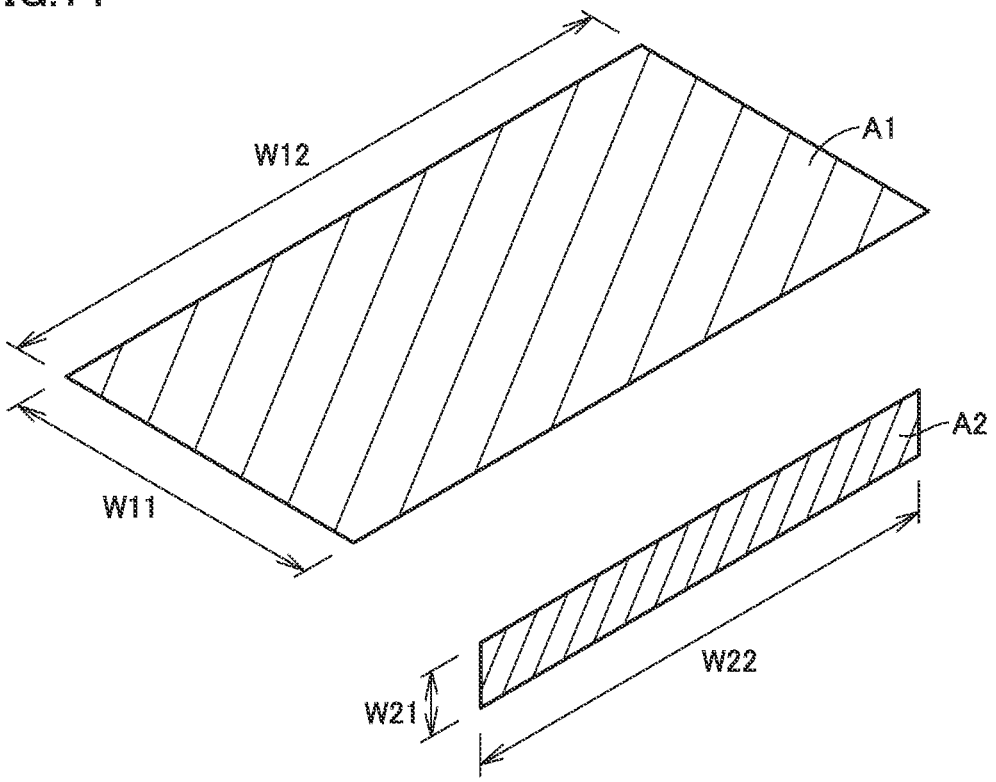
FIG. 14 is a diagram showing the relation between an opening area of a filter duct of the filter device and an opening area of the outside air intake port on the filter duct side, according to an embodiment.

Referring to FIGS. 1, 2, 12, and 14, an outside air intake duct 80 will be hereinafter described. FIG. 12 is a perspective view showing the external appearance of outside air intake duct 80. FIG. 13 is a longitudinal cross-sectional view showing the configuration of outside air intake duct 80. FIG. 14 is a diagram showing the relation between an opening area A1 of filter duct 51 in filter device 50 and an opening area A2 of outside air intake duct 80 on the filter duct 51 side.

Image forming apparatus 100 has a housing 101 provided with outside air intake duct 80. Outside air intake duct 80 includes: an inner duct 81 in communication with filter duct 51 of filter device 50; and a plurality of louvers 80*r* extending in the width direction of image forming apparatus 100. Louvers 80*r* serve to adjust the wind direction and prevent mixture of foreign substances from outside.

Inner duct 81 is provided so as to extend from outside air intake duct 80 to filter duct 51. The air taken in from the outside through outside air intake duct 80 is fed through inner duct 81 into filter duct 51. It is preferable that inner duct 81 is coupled to filter duct 51 at the position upstream from suction fan 52.

Inner duct 81 is formed to have an upper wall and a lower wall such that the distance between the upper wall and the lower wall narrows from outside toward inside. By employing the above-mentioned gradually narrowing shape, the effect of gradually accelerating the flow velocity of the air taken in from outside can be achieved.

Referring to FIG. 13, a center line CL1 of outside air intake duct 80 that is formed by connecting the midpoints between the upper wall and the lower wall of outside air intake duct 80 may cross, at an acute angle (β1), a line VL along which filter duct 51 extends. This configuration can prevent air containing UFP existing inside filter duct 51 from being discharged to the outside.

Referring to FIG. 14, opening area A1 of filter duct 51 of filter device 50 (W11×W12) and opening area A2 of outside air intake duct 80 on the filter duct 51 side (W21×W22) may establish the relation of A1>A2. By establishing this area relation, the inside of filter duct 51 is more negative in pressure than the inside of inner duct 81. Thus, the air containing UFP existing inside filter duct 51 can be further prevented from being discharged to the outside.

Furthermore, the air volume of each of cross flow fan 11 and suction fan 52 (which will be hereinafter collectively referred to as a fan) can be adjusted in accordance with the paper type (basis weight) of sheet of paper S. The air volume of the fan may be controlled to be smaller for thinner sheet of paper S than for thicker sheet of paper S. The fan is not only rotated when sheet of paper S is fed, but also may be started to be rotated while no sheet of paper S is fed in a time period between the previous sheet of paper S and the subsequent sheet of paper S during continuous printing, or may be started to be rotated at the time when heat is started to be applied to fixing device 20.

The discharge amount of UFP can be suppressed by rotating the fan also when no sheet of paper S is fed.

An image forming apparatus includes: a secondary transfer roller configured to transfer a toner image onto a sheet of paper; a fixing device provided downstream in a direction in which the sheet of paper is conveyed, the fixing device including a fixing roller that is configured to fix the toner image transferred onto the sheet of paper; a paper suction fan unit configured to suction air such that air flows over the secondary transfer roller; a guide member provided in the paper suction fan unit and configured to guide air discharged from the paper suction fan unit to be discharged toward the fixing roller; and a filter device through which air discharged from the guide member passes to be discharged. The guide member is configured to guide air in a direction crossing a rotation axis of the fixing roller at least toward each of ends of the fixing roller in a direction of the rotation axis.

In another embodiment, a path displacing device is further included that is provided upstream from the fixing roller, the path displacing device being configured to displace a path of air discharged from the paper suction fan unit in accordance with a size of the sheet of paper.

In another embodiment, when the size of the sheet of paper is relatively large, an air path on an upstream side of the fixing device is displaced by the path displacing device from a position of the fixing roller.

In another embodiment, the filter device includes: a filter duct configured to gather air discharged from the guide member at one place; and a filter member through which air gathered by the filter duct passes.

In another embodiment, the filter member serves as a filter configured to collect UFP.

In another embodiment, the filter duct is in communication with an outside air intake duct through which outside air is taken in.

In another embodiment, a center line of the outside air intake duct crosses, at an acute angle, a line along which the filter duct extends.

In another embodiment, the outside air intake duct is formed to narrow toward the filter duct.

In another embodiment, a conveyance guide provided with the secondary transfer roller is included. The conveyance guide is provided with an air suction port through which air is caused to flow toward the secondary transfer roller. The air suction port is provided downstream from the secondary transfer roller.

In another embodiment, the air suction port is provided so as to include a center region of the secondary transfer roller.

In another embodiment, the paper suction fan unit includes a fan and is configured to change an air volume of the fan in accordance with a type of the sheet of paper.

In another embodiment, the fan is rotated even when the sheet of paper is not fed.

According to the above-described image forming apparatus, it becomes possible to provide an image forming apparatus configured such that air discharged from a fan for stabilizing the paper conveyance performance is used to cool each end of a fixing roller and then discharged through a filter, to thereby implement excellent paper conveyance performance, an appropriate interior temperature, cooling of each end of the fixing roller, and collection of UFP while suppressing increase in cost and size of the image forming apparatus.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus comprising:

a secondary transfer roller configured to transfer a toner image onto a sheet of paper;

a fixing device provided downstream in a direction in which the sheet of paper is conveyed, the fixing device including a fixing roller that is configured to fix the toner image transferred onto the sheet of paper;

a paper suction fan unit configured to suction air such that air flows over the secondary transfer roller;

at least two guide members provided in the paper suction fan unit and configured to guide air discharged from the paper suction fan unit toward the fixing roller; and a filter device through which air discharged from the guide members passes to be discharged, wherein the guide members are configured to guide air in a direction crossing a rotation axis of the fixing roller and the guide members face different ends of the fixing roller in a direction of the rotation axis, wherein the filter device includes:

a filter duct configured to gather air discharged from the guide member at one place; and a filter member through which air gathered by the filter duct passes, and wherein the filter duct is in communication with an outside air intake duct through which outside air is taken in.

2. The image forming apparatus according to claim 1, wherein the filter member serves as a filter configured to collect UFP.

3. The image forming apparatus according to claim 1, wherein a center line of the outside air intake duct crosses, at an acute angle, a line along which the filter duct extends.

4. The image forming apparatus according to claim 1, wherein the outside air intake duct is formed to narrow toward the filter duct.

5. The image forming apparatus according to claim 1, further comprising a conveyance guide provided with the secondary transfer roller, wherein the conveyance guide is provided with an air suction port through which air is caused to flow toward the secondary transfer roller, and the air suction port is provided downstream from the secondary transfer roller.

6. The image forming apparatus according to claim 5, wherein the air suction port is provided so as to include a center region of the secondary transfer roller.

7. An image forming apparatus comprising:

a secondary transfer roller configured to transfer a toner image onto a sheet of paper;

a fixing device provided downstream in a direction in which the sheet of paper is conveyed, the fixing device including a fixing roller that is configured to fix the toner image transferred onto the sheet of paper;

a paper suction fan unit configured to suction air such that air flows over the secondary transfer roller;

a guide member provided in the paper suction fan unit and configured to guide air discharged from the paper suction fan unit to be discharged toward the fixing roller;

a filter device through which air discharged from the guide member passes to be discharged, a path displacing device provided upstream from the fixing roller, the path displacing device being configured to displace a path of air discharged from the paper suction fan unit in accordance with a size of the sheet of paper, wherein the guide member is configured to guide air in a direction crossing a rotation axis of the fixing roller at least toward each of ends of the fixing roller in a direction of the rotation axis.

8. The image forming apparatus according to claim 7, wherein, when the size of the sheet of paper is relatively large, an air path on an upstream side of the fixing device is displaced by the path displacing device from a position of the fixing roller.

9. An image forming apparatus comprising:

a secondary transfer roller configured to transfer a toner image onto a sheet of paper;

a fixing device provided downstream in a direction in which the sheet of paper is conveyed, the fixing device including a fixing roller that is configured to fix the toner image transferred onto the sheet of paper;

a paper suction fan unit configured to suction air such that air flows over the secondary transfer roller;

a guide member provided in the paper suction fan unit and configured to guide air discharged from the paper suction fan unit to be discharged toward the fixing roller; and a filter device through which air discharged from the guide member passes to be discharged, wherein the guide member is configured to guide air in a direction crossing a rotation axis of the fixing roller at least toward each of ends of the fixing roller in a direction of the rotation axis, and wherein the paper suction fan unit includes a fan and is configured to change an air volume of the fan in accordance with a type of the sheet of paper.

10. The image forming apparatus according to claim 9, wherein the fan is rotated even when the sheet of paper is not fed.

* * * * *